US005746907A

United States Patent [19]

Wielers et al.

[11] Patent Number: 5,746,907

[45] Date of Patent: May 5, 1998

[54] METHOD TO REMOVE METALS FROM RESIDUALS

[75] Inventors: Antonius Franziskus Heinrich Wielers, Richmond; Vitold Raimond Kruka, Houston, both of Tex.

[73] Assignee: Shell Oil Company, Houston, Tex.

[21] Appl. No.: 603,491

[22] Filed: Feb. 20, 1996

Related U.S. Application Data

[63] Continuation of Ser. No. 245,143, May 16, 1994, abandoned.

[51] Int. Cl.[6] ..... G10G 32/02; G10G 45/00

[52] U.S. Cl. ..... 208/251 H; 208/251 R; 208/211; 208/216; 204/513; 204/560; 204/561; 204/563; 204/564; 204/567

[58] Field of Search ..... 208/251 R, 251 H, 208/211, 216; 204/513, 560, 561, 563, 564, 567

[56] References Cited

U.S. PATENT DOCUMENTS

| | | | |
|---|---|---|---|
| 2,870,081 | 1/1959 | Frey | 204/188 |
| 2,996,442 | 8/1961 | Eberly, Jr. et al. | 204/184 |
| 3,153,623 | 10/1964 | Eldib et al. | 204/190 |
| 3,582,489 | 6/1971 | Meadow et al. | 204/190 |
| 3,766,058 | 10/1973 | Hensley, Jr. | 208/210 |
| 3,770,605 | 11/1973 | McCoy | 204/188 |
| 3,799,855 | 3/1974 | Franse | 204/188 |
| 3,799,856 | 3/1974 | Franse | 204/188 |
| 3,839,176 | 10/1974 | McCoy et al. | 204/560 |
| 3,857,770 | 12/1974 | Keller | 204/188 |
| 3,928,158 | 12/1975 | Fritsche et al. | 204/188 |
| 3,951,771 | 4/1976 | Burger | 204/190 |
| 4,166,026 | 8/1979 | Fukui et al. | 208/210 |
| 4,248,686 | 2/1981 | Gidaspow et al. | 204/184 |
| 4,370,236 | 1/1983 | Ferguson | 204/136 |
| 4,431,526 | 2/1984 | Simpson et al. | 208/211 |
| 4,444,655 | 4/1984 | Shiroto et al. | 208/210 |
| 4,451,354 | 5/1984 | Stuntz | 208/56 |
| 4,520,128 | 5/1985 | Morales et al. | 502/210 |
| 4,534,852 | 8/1985 | Washecheck et al. | 208/89 |
| 4,657,664 | 4/1987 | Evans et al. | 208/211 |
| 4,680,105 | 7/1987 | Combs et al. | 208/251 |
| 4,836,914 | 6/1989 | Inoue et al. | 208/251 H |
| 4,908,344 | 3/1990 | Pereira et al. | 502/313 |
| 5,106,468 | 4/1992 | Chimenti | 204/180.1 |

FOREIGN PATENT DOCUMENTS

| | | |
|---|---|---|
| 894136 | 4/1962 | European Pat. Off. . |
| 0 555 593 A1 | 8/1993 | European Pat. Off. . |
| 2599-375-A | 12/1987 | France . |

*Primary Examiner*—Walter D. Griffin
*Attorney, Agent, or Firm*—Del S. Christensen

[57] ABSTRACT

A method is provided to remove metals from a residual oil containing an initial amount of a selected metal, the method comprising the steps of:

providing a vessel for exposing the residual oil to a DC electric field having a strength of about one kV/inch or greater, passing the residual oils through the vessel whereby at least ten percent by weight of the initial amount of the selected metal is removed by attraction to an electrode; and passing the residual oil that has been passed through the vessel over a hydrodemetalization catalyst in the presence of hydrogen. Metal containing particles and other toluene insoluble organic and inorganic solids are effectively removed from residual oil streams by treatment with a DC electrical field prior to hydrodemetalization resulting in significant increases in useful lives for downstream hydrodemetalization catalyst. The vessel preferably provides a residence time of between about two minutes and about two hours and contains one or more electrodes, the electrodes having a total surface area of between about 0.01 and about one $m^2$/(ton/day) based on the total residual oil. The electrodes are preferably coated with a polymeric coating to enhance cleaning of the electrodes

11 Claims, 1 Drawing Sheet

METHOD TO REMOVE METALS FROM RESIDUALS

This is a continuation of application Ser. No. 08/245,143 filed May 16, 1994, now abandoned.

FIELD OF THE INVENTION

The present invention relates to a method to upgrade crude oil residual by removal of inorganic solids and then processing the crude oil residual through a reactor containing a catalyst in the presence of hydrogen.

BACKGROUND OF THE INVENTION

Use of hydrocarbon fuels containing high levels of sulfur has become restricted in many parts of the world. For example, almost all residual fuels containing more than 1.6% by weight sulfur produced on the West Coast of the United States are exported from the United States due to the absence of a domestic market. High sulfur residual fuels have always commanded low prices, and the differential between prices of high sulfur and low sulfur products is expected to increase further in the future. Many processes are available to upgrade high sulfur residuals. But many refiners continue to sell low value residuals rather than to invest the capital required for these processes because of the shortcomings of these prior art processes.

The most common residual upgrading process is delayed coking. Delayed coking produces some lighter hydrocarbon products, but the major product is coke, and coke is not a particularly high value product. Gasification type processes are known that convert the residual into gases. Sulfur can be easily removed from these gases, resulting in a clean fuel. But the major product of these gasification processes is a low BTU gas that generally does not have a high value due to availability of alternative fuels Recently, processes have been placed into commercial operation that remove sulfur from residual oils using fixed bed catalysts in the presence of significant hydrogen partial pressures. Some of these processes include hydrocracking of the residual oils in a catalyst bed subsequent to the removal of a significant portion of the sulfur. In these processes, an initial fixed bed containing a demetalization catalyst removes metals. Initial metal removal is required because metals such as vanadium and nickel will cause deactivation of hydrodesulfurization catalysts. Demetalization catalysts become saturated with metals and must be eventually regenerated or replaced. Asphaltenes also tend to form coke on the catalyst and block pore openings and plug the catalyst bed.

Residual oil streams may contain iron as iron sulfides and iron oxides in relatively small amounts, but these small amounts cause a significant problem when these streams are passed over demetalization catalysts. It has been found that the iron compounds tend to deposit near pore openings in catalysts, tending to rapidly block much of the catalyst surface area. Once deposited, iron also promote deposition of other metals, compounding the problem of pore blockage.

Other inorganic solids present in residual oils include sodium, magnesium, and calcium salts. For example, vacuum residuals from Chinese crude oils Chengbei, Shengli, and Yangsanmu were found to contain, respectively, 117, 39, and 25 ppm by weight calcium. These other inorganic solids may also cause pore plugging when such streams are passed over hydrotreating catalysts. Toluene insoluble organics (sludge) present in residual oils also plug catalyst pores.

Catalysts and processes for demetalization and desulfurization of residual oils are disclosed in, for example, U.S. Pat. Nos. 4,908,344; 4,680,105; 4,534,852; 4,520,128; 4,451,354; 4,444,655; 4,166,026; and 3,766,058. The rate at which the demetalization catalyst in a fixed bed reactor loses activity is critical to the economics of each of these processes because of the expense of shutting down the process to replace the catalyst.

An improved commercial process for removal of metals from residual oils includes continuous addition and removal of demetalization catalyst from a reactor in order to achieve an acceptable time period between shutdowns and reasonably sized reactor vessels. This is referred to as "bunkering" of catalyst.

Even with bunkering of demetalization catalyst, a considerable economic incentive exists to extend the life of the demetalization catalyst or alternatively to permit processing of residuals having higher initial levels of metals.

Removal of solids from petroleum residual oil using a DC electric field having at least 5 Kvolts per inch of potential is disclosed in U.S. Pat. Nos. 3,799,855 and 3,928,158. The petroleum residue is exposed to the electric field in a vessel containing non-conductive spheres. After solids are deposited on the spheres due to the presence of the electrical fields, the solids are removed from the spheres by removing the electrical field or reversing the electrical field polarity, and backflushing with a wash liquid. The liquid wash preferably includes a small amount of nitrogen gas to improve removal of solids from the spheres. This process becomes less suitable when large liquid throughput rates are required, as in residual oil conversion.

Metals removal from residuals using DC electric fields is also disclosed in U.S. Pat. No. 2,996,442. The process of this patent includes preheating the residue to a temperature from about 600° F. to about 900° F. for a time period of about 0.3 to about 10 hours prior to subjecting the residual to the DC electrical field. The residual is diluted with a solvent such as naphtha after the preheating step. A precipitate forms upon contact of the solvent with the preheated oil. The DC electrical field then removes the precipitate. Addition of the solvent requires a subsequent distillation step to recover the solvent. Such a distillation would be very expensive both in operating costs and capital costs.

U.S. Pat. No. 4,248,686 discloses a process to remove solids from a hydrocarbon stream using a filter and a high voltage DC electrical field. This patent discloses adding a surfactant such as a dioctyl sodium sulfosuccinate to the slurry to improve the electrophoretic mobility of solids in the slurry. Only surfactants in the sodium salt form are specifically mentioned, and use of such a surfactant in a process to remove metals from residual oil would undesirably increase the amount of sodium in the residual oil.

It is therefore an object of the present invention to provide a method to remove metals from a residual oil utilizing a pretreatment of the residual oil with a DC electrical field having a field strength in excess of about one Kv/inch. It is a further object to provide such a method utilizing a metals removal catalyst wherein the metals removal catalyst is not consumed at a high rate. It is another object to provide such a method wherein the DC electrical field may be practically applied in a limited number of large scale vessels, allowing high oil throughput rates, and distillation of a solvent is not required.

SUMMARY OF THE INVENTION

These and other objects are accomplished by a method to remove metals from a residual oil containing an initial amount of a selected metal, the method comprising the steps of:

providing a vessel for exposing the residual oil to a DC electric field having a strength of about one Kv/inch or greater;

passing the residual oil stream through the vessel whereby at least ten percent by weight of the initial amount of the selected metal is removed by attraction to an electrode; and passing the residual oil that has been passed through the vessel over a hydrodemetalization catalyst in the presence of hydrogen.

The vessel preferably provides a residence time of between about two minutes and about two hours and one or more electrodes, the electrodes having a total surface area of between about 0.01 and about 1.0 $m^2$/(ton/day) based on the total residual oil. The electrodes are preferably polymer coated to enhance cleaning of the electrodes.

Hydrodemetalization catalysts often have shorter than desired lives because catalyst pores become prematurely plugged with inorganic and organic solids. Organic solids include toluene insoluble material. Inorganic solids typically have a high iron content, and also contain significant amounts of inorganic salts such as sodium chloride, calcium salts and magnesium salts. Iron is typically present in the form of iron oxides and iron sulfides. These solids are effectively removed from residual oil streams by treatment with a DC electrical field according to the present invention prior to hydrodemetalization resulting in a significant increase in the useful life of the hydrodemetalization catalyst.

The electrodes are preferably coated with a polymeric material to improve electrode cleaning rate. Preferred polymeric materials are siloxane polymers and tetrafluoroethylene polymers.

Removal of solids from residual oil using the DC field of the present invention can be enhanced by addition of a surfactant to the residual oil.

DETAILED DESCRIPTION OF THE INVENTION

Figure 1:
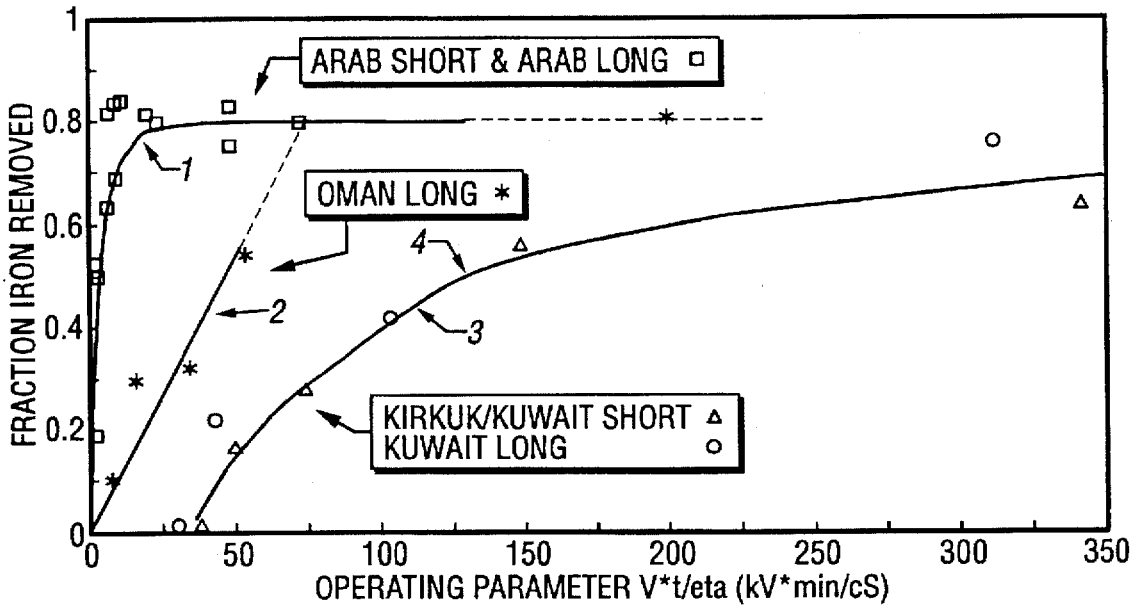
FIG. 1 is a plot of iron removal as a function of a severity factor for five residuals.

The residual oil that is treated in the method of the present invention is preferably an atmospheric column bottom product or a vacuum flasher bottom product, but could be any stream that contains such products. For example, straight crude oil contains these bottoms products, as does thermally cracked or catalytically cracked heavy products. The residual oil is preferably an atmospheric column bottom product or a vacuum flasher bottom product because these streams are essentially free of water as a result of the prior distillation and contain relatively high concentrations of solids because the prior distillation has reduced the total volume of the streams but not removed solids.

The present invention removes more than ten percent by weight of a selected metal. Preferably, greater than 50% of the original amount of selected metal is removed from the oil. The selected metal is a component such as, for example, iron, calcium, sodium, or magnesium. A significant portion of toluene insoluble organic solids, other inorganic solids and some asphaltenes are also removed by exposing the residual oil to a DC electrical field.

Removal of iron can be used as an indicator of the removal of inorganic solids and toluene insoluble solids. Because iron removal can be determined with better accuracy, selection of iron as the selected metal of the present invention is preferred. when iron removal is measured, it will be understood that inorganic solids and toluene insoluble organic solids in general are removed to at least some extent and preferably to a significant extent. The initial amount of iron in the residual oil may be, for example, between about 5 and about 150 parts per million by weight.

Lesser amounts of the selected metal may be tolerated by fixed or bunkered beds of hydrodemetalization catalysts, and greater amounts the selected metal may be more economically removed using other methods. Considerable improvements to hydrodemetalization catalyst lives can be realized when more than about ten percent by weight of the selected metal is removed from the residual oil prior to passing the residual oil over the hydrodemetalization catalyst. Preferably about 50% or more of the selected metal initially present is removed from the residual oil by the DC electrical field of the present invention.

Accumulation of solids on the electrodes will eventually reduce the effectiveness of the electrical field for such removal. Preferably before a significant part of the electrode's effectiveness is lost, solids may be removed from the electrodes by discontinuing or reversing the electrical field and flushing with a fluid such as a gas oil or slurry oil. Reversal of the electrical field enhances solids removal. A plurality of vessels containing electrodes for application of the DC field are preferably provided so that the vessels may be removed from residual oil treating service for the solids removal operation without interruption of residual oil treating process.

An alternative electrode cleaning method is to discontinue or reverse the electrical field, and use residual oil feed as the flushing fluid. The solids laden residual oil exiting the vessel can be routed to an alternate disposition during the cleaning cycle without otherwise interrupting the operation of the vessel.

The electrodes are preferably coated with a polymer to enhance electrode cleaning rates. The polymer is preferably one that can be applied in a thin coating, so that the electrical field strength is minimally impaired. The polymer is also preferably capable of withstanding desired electrode operating temperatures. Particularly preferred polymers include tetrafluoroethylene polymers, siloxane polymers, and epoxy resins. Coatings of these polymers are readily available in forms that can be applied to electrodes such as stainless steel electrodes by brushing, dipping the electrode in a solvent containing the polymers, or by spraying the coating onto the electrode. A suitable tetrafluoroethylene polymer is "CAMIE 2000TFA COAT" sold by DuPont, and a suitable siloxane polymer is "AMERCOAT 738" sold by Amron Co.

The electrodes are preferably parallel plates stacked in a vertical vessel with the plates parallel to the residual oil flow, with between about one and about four-inch spacing between the plates. About two-inch spacing between plates is preferred. About two-inch spacing is sufficient to prevent shorting of the plates due to sloughing of small amounts of solids, and still results in a sufficient amount of electrode surface area within a volume that results in a preferred residence time. The time period before loaded electrodes must be cleaned will be about proportional to the surface area of electrodes upon which the solids may accumulate. Having sufficient electrode surface area allows one to five days of continuous operation between times when solids must be removed from the electrodes The surface area of the electrodes, including both the positive and the negative electrodes is preferably between about 0.01 and about 1.0 $m^2$/(ton/day) and more preferably between about 0.05 and about 0.4 $M^2$/(ton/day) based on the total residual oil in order to provide a reasonable time period between electrode cleaning operations.

The parallel plate electrode configuration is simple and readily scaled up to a capacity that could be of commercial applicability.

The parallel plate electrodes may be corrugated or flat plates. Plates having vertical corrugations are preferred because flow will be more uniform through the plates if they are corrugated. Corrugated plates also provide more strength for the weight of the plate, and therefore plates of similar thickness would have less tendency to buckle. The charge on the plates are alternated so that each side of the plates functions as an electrode and provides surface area upon which solids can accumulate.

The electrodes could be of other shapes, such as cylinders, but parallel plates are convenient and effective.

The vessel is preferably vertical and has a residence time of between about two minutes and about two hours, and more preferably between about five minutes and about thirty minutes. Multiple vessels are preferred, the vessels providing sufficient volume so that one of the vessels may be taken off-line individually for removal of accumulated solids from the electrodes without impairing residual oil throughput at preferred residence times.

The residual oil is preferably treated by the DC field when the residual oil is at a temperature that permits acceptable mobility of solids within the residual oil. Typically, this will require a temperature of between about 200° F. and about 700° F. for atmospheric column bottoms or vacuum flasher bottoms. A temperature of between about 300° F. and about 600° F. is preferred.

Removal of solids generally increases with increasing DC field strength. The maximum field strength is limited by the conductivity of the residual oil. It has been surprisingly found that solids can be separated from residual oils at considerably higher conductivities than from other hydrocarbons. A possible explanation for this observation is that the conductivity of residual oils is to a significant extent caused by the relatively high amount of asphaltenes present.

Surfactants may be added to the residual oils to enhance removal of organic or inorganic solids by the DC electrical field of the present invention. The surfactant is preferably an oil soluble anionic surfactant such as an diammonium laurylsulfate or an ammonium alkylsulfosuccinate. Anionic surfactants in the form of ammonium salts are most preferred because the ammonium salts do not add additional metal ions to the residual oils that could be detrimental to downstream catalysts. Concentrations of between about 5 and about 100 ppm by weight of surfactant, based on the total residual oil, is preferred when surfactants are used.

The DC electrical field of the present invention also removes some asphaltenes from the residual oil. This can be an advantage because asphaltenes tend to form coke on fixed bed catalysts. The residence time of the residual oil in the present invention may be sufficient to result in removal of at least about one third of the asphaltenes present in the initial residual oil. If it is desired to remove asphaltenes, it has been found that addition of surfactants to the residual oil is particularly effective to improve removal of asphaltenes. Because hydrodemetalization catalysts can be economical and effective for removal of asphaltenes, it may be preferable to adjust the residence time, temperature, the concentration of a surfactant, or the strength of the DC field to effectively remove inorganic solids, but not asphaltenes. This would significantly decrease electrode fouling while not significantly decreasing downstream catalyst activities.

The hydrodemetalization catalyst through which the residual oil is passed after at least ten percent of the selected metal is removed by the DC electrical field of the present invention may be any of those known to be useful for hydrodemetalization of residual oils by those of ordinary skill in the art. Each of these known catalysts benefits from removal of solids prior to passing the residual oils over the catalyst.

After the residual oil is subjected to hydrodemetalization, the residual oil is then preferably further processed to increase the value of the products. Desulfurization and denitrification by known processes can improve the residual oil's properties as either a fuel or as a feed for a further conversion process. Further conversion processes will generally be either a fluidized bed catalytic cracking process or a hydrocracking process using a catalyst in a fixed bed reactor.

EXAMPLE 1

The effectiveness of a DC electrical field in removal of iron components from residual oils was demonstrated by passing different residual oils through a cylindrical vessel having a cylindrical anode having an inside diameter of 1 8/10 inches and a length of 2 6/10 inches and a 1/8-inch diameter cathode rod centered in the longitudinal axis of the anode. An Arabian Heavy long residue having an initial iron content of about 18 ppm by weight was passed through the DC field at a flowrate that resulted in a residence time of 0.9 hours. The residue was preheated to a temperature of 350° F. The iron content of the residue was reduced to about 2.5 ppm with a 10 Kv difference between the electrodes and about 7.5 ppm with 5 Kv difference between the electrodes. The solids accumulated on the electrodes included iron, present as iron oxide and iron sulfide, and sodium, present mostly as sodium chloride, and toluene insoluble organic material.

EXAMPLE 2

Static experiments were carried out in cylindrical cells equipped with two flat plate electrodes. The flat plates were about 11/16 inches apart. Each plate had a length of about 2.71 inches and a width of about 1.1 inches. The cell was filled with oil and DC potential was then placed across the electrodes for the test residence time. Tests were performed under the following conditions: temperatures ranging from 200° F.–700° F,; field strengths from 2–7 Kv; and residence times ranging from 5 minutes to 5 hours. Upon completion of each test the electrodes were removed and the oil was analyzed with respect to the concentration of inorganic and organic particles. Five different residual oils were exposed to the DC electric fields in this series of experiments. FIG. 1 is a plot of the fraction of iron removed versus a severity factor where the severity factor is residence time in hours times the applied voltage in Kvolts divided by the residue viscosity in centistokes. Because the electrode spacing was identical for each of these tests, the electrical field strength is proportional to the voltage applied between the electrodes The five residues and the lines on FIG. 1 that correspond to the residues were: Arabian Heavy Long Residue ("AHL")(1), Arabian Heavy Short Residue ("AHS")(1), Oman Long Residue ("OL")(2), Kirkuk/Kuwait Short Residue ("KKS")(3), and Kuwait Long Residue ("KL")(4). The Arabian Heavy Long and the Arabian Heavy Short are represented by the same line. TABLE 1 below lists metal contents, C5 asphaltenes and viscosities of these residues.

TABLE 1

| Composition (ppmw) | KKS | AHS | AHL | KL | OL |
|---|---|---|---|---|---|
| Al | 3 | 4 | <2 | <1 | 3 |
| Ca | <1 | 6 | <1 | 2 | 3 |
| Co | <1 | <1 | <1 | <1 | <1 |
| Cr | 2 | 2 | <1 | <1 | <1 |
| Fe | 19 | 38 | 18 | 19 | 16 |
| K | <1 | <1 | <1 | <1 | <1 |
| Mg | <1 | 6 | <1 | <1 | <1 |
| Mo | 2 | 2 | <1 | <1 | <1 |
| Na | 11 | 39 | 24 | 2 | 1 |
| Ni | 56 | 52 | 27 | 13 | 9 |
| Si | <1 | <1 | <1 | <1 | <1 |
| V | 164 | 164 | 83 | 42 | 11 |
| Zn | 2 | 3 | 2 | 2 | 1 |
| $C_5$ Asphaltenes, % w | 25.9 | 20.4 | 11.6 | 5.5 | 2.72 |
| Viscosity, cs @ C | 1407 @ 125<br>378 @ 150<br>141 @ 175 | 1407 @ 125<br>444 @ 150<br>160 @ 175 | 166 @ 100<br>28 @ 150<br>16 @ 175 | 7189 @ 23<br>452 @ 52<br>239 @ 61 | 2248 @ 27<br>794 @ 38<br>345 @ 49 |

From FIG. 1 it can be seen that about 80% of the iron in each residue can be removed at a sufficient severity for each of the five residues although the severity required to obtain a target level of iron removal differs between residues.

EXAMPLE 3

Figure 2:
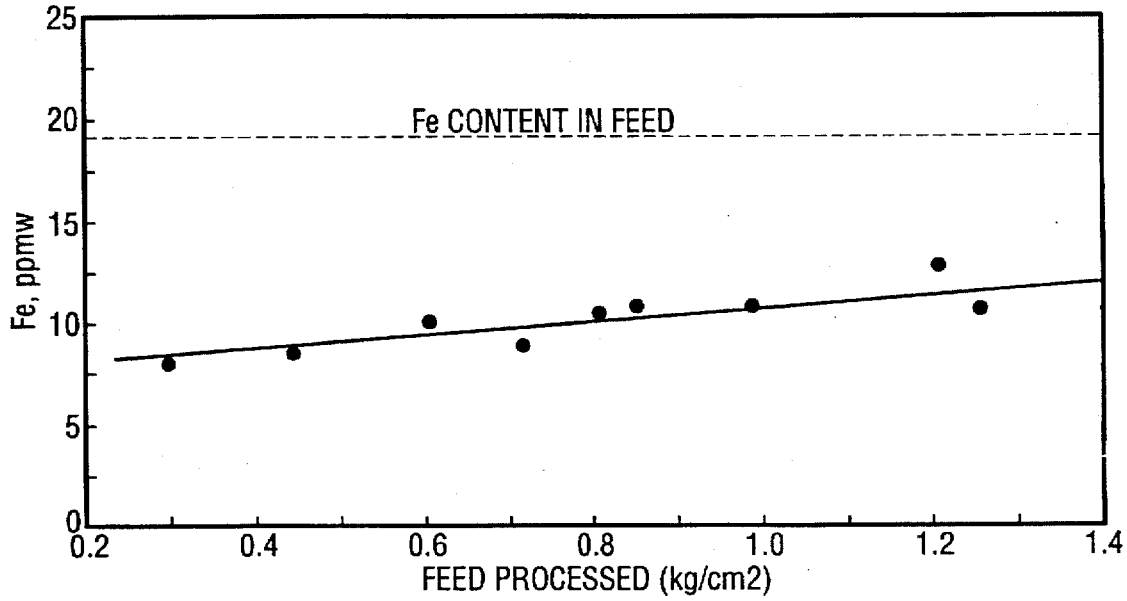
FIG. 2 is a plot of iron removal as a function of the amount of residual treated.

The rate at which electrodes will foul and cause a decrease in the performance of the apparatus of Example 1 was determined by operating the apparatus at a residue feed rate that resulted in about a ten minute residence time at a temperature of about 390° F. FIG. 2 is a plot of the iron content of the treated residue as a function of the amount of residue treated per unit of electrode surface area. From FIG. 2 it can be seen that the iron in the treated residue gradually increased as more residue was processed. It was further found that after the electrodes were rinsed with gas oil with the electrical field removed, performance of the electrodes consistently returned to a start-of-run effectiveness

EXAMPLE 4

Removal of metals other than iron was demonstrated using the apparatus of Example 2. AHS residue was treated with a severity of 12.5 Kv-min/Cst and at 600° F. The applied voltage was 5 Kv and the residence time was one half of an hour. Initial and treated oil metals content are listed in Table 2 below.

TABLE 2

| ppmw | Initial | Treated |
|---|---|---|
| Al | 4 | <3 |
| Ca | 6 | 2 |
| Fe | 39 | 5 |
| Mg | 6 | 3 |
| Mo | 2 | 2 |
| Ni | 52 | 52 |
| Na | 39 | 16 |
| V | 164 | 163 |
| Zn | 3 | <1 |
| Ash % wt | 0.057 | 0.046 |

From Table 2 it can be seen that concentrations of metals other than nickel, vanadium and molybdenum are significantly reduced. Nickel and vanadium are present mostly associated with asphaltenes, and are not significantly removed.

EXAMPLE 5

Tests were run as described above in Example 2 with three different anionic surfactants added to KKS residual oil. The tests were run at a temperature of 500° F. with five hours residence time and a five Kvolt differential potential, resulting in a severity of about 62.5 Kv-min/cs at this example's electrode geometry. The surfactants and the results are listed in Table 3 below.

TABLE 3

| Surfactant | Type | PPM Surf. | PPM Iron in Residue |
|---|---|---|---|
| None | N/A | N/A | 17 |
| Mackanate LA | diammonium laurylsulfo-succinate | 2000 | 9 |
| Rhodapon L-22 | ammonium laurylsulfate | 2000 | 10 |
| Stepanol AM | ammonium laurylsulfate | 2000 | 2 |
| Mackanate LA | diammonium laurylsulfo-succinate | 100 | 9 |

From Table 3 it can be seen that each of the three surfactants were effective in improving the removal of iron by the DC field, and that the concentration of effective surfactant needed may be below 100 ppm. It can also be seen from the results in Table 3, and the results of Examples 2 and 3, that a severity of about ten to about fifty Kv/inch-min/cs would be sufficient to achieve maximum solids removal from many common residues. Although some residues may require greater severity, these residues may be treated by addition of a surfactant to result in a residue from which about ten percent or more of the iron could be removed using a severity of between about two and about fifty Kv/inch-min/cs.

EXAMPLE 6

Tests were performed to determine the effect of high levels of surfactant using the apparatus of Example 2. The surfactant used was ASA-3, available from Royal Lubricants Company, Inc. of East Hanover, N.J. This surfactant is marketed as an antistatic jet fuel additive and is a solution in xylene of chromium and calcium organic salts stabilized with a polymer. A residence time of two hours was used, a temperature of 600° F., a five KVolt power differential, and KKS residual oil. The metals content of the treated KKS residual is listed below in Table 4.

TABLE 4

| TEST No. | 1 | 2 | 3 |
|---|---|---|---|
| ASA-3 % wt | 0.2 | 0.5 | 1.0 |
| ppm-wt | | | |
| Ca | 5 | 14 | 24 |
| Cr | 6 | 6 | 7 |
| Fe | 15 | 8 | 6 |
| Ni | 54 | 48 | 40 |
| Na | 13 | 13 | 14 |
| V | 162 | 129 | 130 |
| Zn | 1 | 1 | 1 |

From Table 4 it can be seen that ASA-3, at increasing concentrations, increases removal of the vanadium and nickel, which are normally associated with asphaltenes. Calcium, in particular, appears to be added to the residual oil with the ASA-3 because the level of calcium in the treated oil increases with the addition of ASA-3.

EXAMPLE 7

The effectiveness of a polymeric coating to improve the cleaning of the electrode was demonstrated by conducting static experiments in the cell described in Example 2 with the electrodes coated with "CAMIE 2000 TFA COAT" sold by DuPont. This is a tetrafluoroethylene polymer coating. Arabian Heavy Long Residue was placed in the cell for two hour cycles at 300° F., with fresh residue for each cycle. After three cycles, the electrodes were covered with a layer of solids. The electrodes were then placed in a 350° F. gas oil bath without electrical power applied. After five minutes, the electrodes were free of solids. A comparative experiment was performed with the same procedure except uncoated stainless steel electrodes were used. The uncoated stainless steel electrodes collected a similar amount of solids after three cycles, but after being in the gas oil bath for an hour; still were coated with some solids. This experiment demonstrated the effectiveness of a polymeric coating in improving the cleaning of the electrode

We claim:

1. A method to remove metals from a residual oil containing an initial amount of a selected metal, the method comprising passing the residual oil over a hydrodemetalization catalyst in the presence of hydrogen, the improvement consisting essentially of the steps of:

providing a vessel for exposing the residual oil to a DC electric field having a strength of about one kV/inch or greater and providing a residence time of between about two minutes and about two hours and one or more electrodes, the electrodes having a total surface area of between about 0.01 and about one $m^2$/(ton/day) based on the total residual oil; and prior to passing the residual oil over the hydrodemetalization catalyst, passing the residual oil through the vessel wherein residence time of the residual oil in the vessel in minutes times the applied electric field strength in KVolts per inch divided by the viscosity of the residue stream at the temperature of the residue when it is Passed through the vessel in centistokes is between about two and about fifty, whereby at least ten percent by weight of the initial amount of the selected metal is removed by attraction to an electrode.

2. The method of claim 1 wherein a plurality of vessels are provided and metals attracted to the electrode are removed by: discontinuing or reversing the electrical field; and flushing the metal from the vessel using a flushing fluid.

3. The method of claim 2 wherein the flushing fluid is selected from the group consisting of gas oil, residual oil and slurry oil.

4. The method of claim 1 wherein the vessel comprises a plurality of parallel electrode plates spaced between about one and about four inches apart.

5. The method of claim 4 wherein the electrode plates are corrugated plates.

6. The method of claim 1 further comprising the step of adding to the residual oil, prior to passing the residual oil through the vessel, an amount of surfactant effective to improve removal of the selected metal.

7. The method of claim 6 wherein the effective amount of surfactant is about 5 to about 100 ppm by weight of residual oil.

8. The method of claim 7 wherein the surfactant is selected from the group consisting of ammonium laurylsulfate and ammonium alkylsulfosuccinate.

9. The method of claim 1 wherein passing the residual oil through the vessel results in at least about half of the initial selected metal being removed by passing the residual oil stream through the vessel.

10. The method of claim 1 wherein the residual oil is passed through the vessel at a temperature of between about 200° F. and about 700° F.

11. The method of claim 1 wherein the residence time of the residual oil in the vessel is between about five minutes and about thirty minutes.

* * * * *